United States Patent [19]

Yarbrough

[11] Patent Number: 4,867,760

[45] Date of Patent: Sep. 19, 1989

[54] COATED ABRASIVE

[75] Inventor: Walter A. Yarbrough, Greenwich, N.Y.

[73] Assignee: Norton Company, Worcester, Mass.

[21] Appl. No.: 641,647

[22] Filed: Aug. 17, 1984

Related U.S. Application Data

[63] Continuation of Ser. No. 420,466, Sep. 20, 1982, abandoned, which is a continuation-in-part of Ser. No. 280,040, Jul. 6, 1981, abandoned, which is a continuation-in-part of Ser. No. 174,073, Jul. 31, 1980, abandoned.

[51] Int. Cl.[4] ..... C09K 3/14

[52] U.S. Cl. ..... 51/298; 428/102; 428/105; 428/109; 428/284

[58] Field of Search ..... 428/102, 105, 109, 283, 428/284, 257; 51/298

[56] References Cited

U.S. PATENT DOCUMENTS

| | | | |
|---|---|---|---|
| 1,890,502 | 12/1932 | Divine | 51/297 |
| 2,130,944 | 9/1938 | Bowen | 154/2 |
| 2,288,649 | 7/1942 | Robi | 51/297 |
| 2,890,579 | 6/1960 | Mauersberger | 66/192 |
| 3,030,743 | 4/1962 | Raymond | 51/207 |
| 3,146,560 | 9/1964 | Hurst | 51/188 |
| 3,169,899 | 2/1965 | Steuber | 161/72 |
| 3,250,655 | 5/1966 | Adler | 156/181 |
| 3,732,652 | 5/1973 | Furhal et al. | 51/401 |
| 3,819,461 | 6/1974 | Saffadi | 161/58 |
| 3,972,161 | 8/1976 | Zoiss | 51/206 R |
| 3,991,593 | 11/1976 | Bernert et al. | 66/85 A |
| 4,215,516 | 8/1980 | Huschles et al. | 51/399 |

FOREIGN PATENT DOCUMENTS

| | | |
|---|---|---|
| 722882 | 12/1965 | Canada . |
| 45408 | 2/1982 | European Pat. Off. . |
| 890912 | 9/1953 | Fed. Rep. of Germany . |
| 1427569 | 3/1973 | Fed. Rep. of Germany . |
| 2333980 | 7/1976 | Fed. Rep. of Germany . |
| 1410153 | 10/1965 | United Kingdom . |
| 1016484 | 1/1966 | United Kingdom . |
| 1094894 | 12/1967 | United Kingdom . |

OTHER PUBLICATIONS

Interkolor 77, Budapest, Sep. 13–16, 1977, "Zeitgemasse Wirtschaftliche und Asthetische Textilausrustung Deutsche Textiltechnik 9", VEB Fachbuchverlag, Leipzig.

"The Latest Offspring of the Malimo Family", Textima Information, Unitechna Aussenhandelsgesellschaft M.B.H., 7/13/78.

"The Arachne Stitch Bonding Process", W. E. Shinn, The Knitter, Oct. 1968.

International Conference on Manmade Fibres for Developing Countries, 18–23 Jan. 1976, Title: "Prospects of Arachne Non-Woven Fabrics in Developed and Developing Countries", Jaroslav Kopal.

*Primary Examiner*—James J. Bell

*Attorney, Agent, or Firm*—Stephen Borst

[57] ABSTRACT

Stitch bonded fabric or other arrays of substantially coplanar and coparallel yarns non-interlaced with other yarns are employed to reinforce the backing for coated abrasive products. A preferred construction with continuous filament polyester yarns is described, together with the cloth finishing process employed to prepare a backing for coating with abrasive grain. The product is particularly suitable for making coated abrasive belts.

18 Claims, 1 Drawing Sheet

FIG. 3

PRIOR ART

COATED ABRASIVE

This application is a continuation of my copending prior application Ser. No. 420,466, filed Sept. 20, 1982, now abandoned, which was a continuation-in-part of application Ser. No. 06/280,040, filed July 6, 1981 and now abandoned, which was a continuation-in-part of Ser. No. 06/174,073, filed July 31, 1980 and now abandoned.

FIELD OF THE INVENTION

The present invention relates to abrasive products comprising a new and novel flexible backing on at least one side of which are adhered abrasive grits, such products being referred to in the art as coated abrasives; more particularly it relates to endless abrasive belts formed from such coated abrasive products.

The fabric substrate for the flexible backing is produced typically on stitch-through type machines such as Malimo type machines wherein the configurations of the yarn components of the backing are particularly suitable as substrate for coated abrasives. Malimo type fabrics are described in for example Pat. Nos. 2,890,579; 3,030,786; Re. 25,749; 3,253,426; 3,274,806; 3,279,221; 3,309,900; 3,389,583; 3,392,078; 3,440,840; 3,452,561; 3,457,738; 3,460,599; 3,540,238; 3,541,812; 3,567,656; 3,592,025 and 4,144,727. These disclosures are incorporated herein by reference.

Such configurations of the yarns are also included within the scope of this invention.

Coated abrasives, in general, have been made on backings ranging from paper, cloth, leather, to plastic films and metal sheets. Except for specialty items the greater majority of all coated abrasive products are made on paper or woven cloth backings.

Coated abraisves, often subject to high stresses in operation, are made from strong paper backings, vulcanized fiber backings, or, for strength and flexibility woven cloth backings. Laminates of various of these materials have also been used and taught in the present literature.

Problems connected with the use of woven cloth as a backing for coated abrasive articles, and for belts in particular, are the elongation characteristic inherent in woven cloth, due to the repeated curvature in the yarns, inherently produced by the interlaced nature of the material, and a weakening of the material in certain circumstances due to the inherent presence of "knuckles" at the crossover points in the yarn. Knuckles are the small bumps on the surface of woven cloth caused by yarns curving to cross over other yarns. The presence of such knuckles is believed to be responsible for the catastrophic failure of coated abrasive articles, particularly belts, in certain severe grinding operations.

SUMMARY OF THE INVENTION

The desirable properties of woven textiles as a backing material for coated abrasives are retained, and many of the undesirable properties are avoided, by the use in the present invention of arrays of substantially coplanar and coparallel textile yarns, which yarns are not woven but are bonded into the structure of the coated abrasives by other means.

Theoretically ideal properties for coated abrasives would be expected for backings in which the arrays of yarns are exactly coplanar and coparallel. However, such exactitude in the arraysing of the yarns is neither practical to achieve routinely nor necessary to derive benefit from the use of this invention.

For my purposes, an array of yarns is substantially coplanar if all the yarns of the array can be accommodated in the space between two parallel planes which are separated by a distance of four times the average diameter of the yarns in the array. An array is substantially coparallel if the largest angular difference in direction between any two yarns in the array is no more than thirty degrees.

The reinforcing yarns in the products of my invention provide most of the tensile strength of the backings, as do the yarns in conventional coated abrasives with woven cloth substrates, but the use of such fabrics as stitch bonded Malimo fabrics, or adhesive bonded layers of oriented yarns, results in the elimination of many of the disadvnatages referred toa bove in connection with the use of conventional woven cloth.

Thus, the elongation and failure problems caused by the presence of knuckles in the woven cloth are avoided.

A major advantage of the non-interlaced fabrics when employed as substrates for coated abrasives is the fact that such fabrics can be produced at much higher rates of speed than can conventional woven textiles, thus increasing the productivity and lowering the cost of manufacture.

Referring specifically to the stitch bonded, Malimo type fabrics, these materials are produced by laying fill yarns over warp yarns and, with a third yarn, stitching the warp and fill yarns together. Because of the space requirement for the mulitple stitching needles, there is an upper limit on the number of warp ends per inch in such fabrics. Because of this, the stitch bonded fabrics tend to be or may be of more open construction than conventional woven cloth for coated abrasive use. The greater openness, combined with the use of strong multifilament yarns permits design of fabric having lower weight than conventional woven fabrics of the same or lower strength and tear resistance, thus economizing on the use of raw materials. Thus special procedures may be required in filling the spaces between the yarn in such fabrics. The overall production of coated abrasive from stitch bonded fabrics is, however, closely analogous to production from conventional woven cloth.

The steps of sizing the yarn, back filling or sizing, saturating, front sizing, applying a maker coat, applying abrasive, and finally applying a "sand" size coat may all be used in coated abrasive production from the Malimo type, or stitch bonded fabrics. The abrasive used should be one of the conventional materials employed for such purposes, such as aluminum oxide (with possible modifying constituents), zirconia-alumina, silicon carbide, garnet, ceria, flint, or iron oxide.

Adhesive bonded fabrics may be produced in a similar manner as the stitch bonded, but with an application of suitable adhesive, at the point in the manufacture where otherwise the third yarn would be used to stitch bond the warp and crossing threads together.

Similarly the thermally bonded fabrics may be produced by applying heat at the points of junction of the warp and cross threads to fuse or soften the yarns of a coating previously applied to the yarns.

In some cases it may be desirable to insert a thin tissue sheeting between the arp and fill yarns, to aid in preventing the back-fill treatment from penetrating too far into the cloth. This can be done in the Malimo machine during the manufacture of the backing.

Instead of oriented fill yarns, a random web of fill yarns can be employed, as in the Maliwatt type of MALIMO fabric (as opposed to the Malimo type). Such web should be selected to contain fibers which present sufficient surface for good adhesion. Machiens are available (such as Model 14001) which will produce both the Malimo type and the Maliwatt type fabrics.

The present invention is particularly suitable for producing coated abrasive stock suitable for forming coated abrasive belts. The ability to control the longitudinal strength and stretch properties of the material is important in this regard. While the total strength of a woven fabric in the warp direction cannot always be predicted by summing the strengths of the individual warp yarns and the stretch properties can almost never be predicted from the stretch of the individual yarns, both these properties can be more readily controlled and predicted in the fabric designs employed in the present invention. In addition any tendency of coated abrasive belts to split when subject to stresses in use due to the effect of the interlaced filling (weft) yarns is eliminated by the use of the non-interlaced backing construction disclosed herein. By "non-interlaced backing", I mean a backing reinforced with non-interlaced arrays of substantially coplanar and coparallel yarns as described above.

The particular finishing materials employed are not critical and many variations are possible provided proper cover and adhesion are achieved.

Important aspects of the finishing are obtaining good adhesion to the backing, properly filling the cloth and preparing its surface for the maker coat to hold the abrasive, and adequately bonding the yarns so that the end product resists delamination, splitting, and tearing. Adequate flexibility for the end use intended is also important. Thus the particular chemical structure of the finishing compositions is not critical, except to the extent that it affects the physical properties described above.

Other methods than the Malimo machine may be used to produce the arrays of yarns which are useful in preparing the non-interlaced backings of this invention. For example, prepared cut-to-length crossing yarns may be laid across an array of warp yrans, for example at right angles, by a suitable machine, or manually. The warp and overlaid yarns may then be consolidated by a stitching yarn or by adhesive means. U.S. Pat. No. 3,250,655 shows an adhesively bonded fabric of this type. Other machines are known which wind a filling (so-called) array of yarns around the longitudinal warp yarns arrayed in a tubular configuration. Other machines or methods such as weft insertion machines can be employed to produce yarn arrays suitable for the present invention.

The presently preferred material for the warp yarns is continuous filament polyester having relatively high strength and low elongation properties. Obviously other yarns of similar or higher strength properties and similar or lower elongation under load, may be used. In less critical applications yarns with less strength and higher elongation could be used, and other advantages of the present invention be still retained.

Besides the various synthetic organic yarns, glass or metal yarns may be employed as part or all of the yarn arrays.

The preferred yarns in the fill direction are texturized continuous filament synthetic yarns, as in the example below. Natural and synthetic staple fiber textile yarns may be employed. Continuous filament yarns are particularly sueful is they are texturized, given a false twist, or are otherwise produced to have a high bulk or surface area so that good adhesion to the cloth finishing materials is achieved.

DISTINCTIONS FROM THE PRIOR ART

As described in detail elsewhere in this application, my invention is distinct from all previous types of coated abrasives which have employed woven cloth as a substrate for coated abrasive backings, because my use of yarns achieves better properties at less cost than by using yarns woven together before they are incorporated into coated abrasive backings.

I consider that the prior art represented by three previous patents is most relevant to understanding my own invention. These patents are U.S. Pat. Nos. 3,146,560 (Hurst), 3,030,743 (Raymond) and 3,732,652 (Furgal).

The parts of the Hurst specification which I consider most relevant are FIG. 1; FIG. 2, col. 3, lines 17-19; col. 8, lines 49-52 and lines 69-75; and col. 17, lines 8-12 and lines 39-44.

Among Hurst's many disclosures, the one which I consider most similar to my own invention is that depcited in FIG. 2. This is essentially an abrasive tape about once quarter inch wide with abrasive grains adhered to all its exterior surfaces and with six itnernal textile yarns reinforcing the entire structure. Hurst states (page 8, lines 48-50) that these six strands are "disposed substantially inparallelism". He does not give any quantitative definition of what he means by this term. However, I consider it highly unlikely that the yarns in products described by Hurst could consistently meet my own definition of "substantially parallel" as given above, because FIG. 1 shows the yarns anything but parallel, Hurst states (page 7, lines 21–24), "The strands were fed in at a rate that permitted the individual strands to be slack and to bend back and forth in the resin", and there is no apparent means in Hurst's apparatus for directing the yarns into a parallel configuration. (The extrusion of the yarns and resin together through a narrow slot as described by Hurst might reasonably be expected to make the yarns in the final product coplanar, but there is nothing evident in the Hurst apparatus which should make the yarns coparallel.) In thea bsence of specific aligning means, the probability of achieving parallel orientation of the yarns would be expected to decrease rapidly as the number of yarns is increased. Hurst states that "from 4 to 6 strands are preferred" (page 76, line 19). It is also true that on page 7, lines 71–74 Hurst states that "extruded materials having other diemsnions have been produced by the same general technique". Hurst's lengthy specification however, does not give any specific directions for doing so.

I believe that it may logically be concluded that, at least for products in which the yarns are coparallel within my definition, the "other dimensions" referred to by Hurst would be restricted to narrower dimensions, or those with fewer than Hurst's preferred number of yarns. In general, there is little practical interest in performing the grain coating step in the manufacture of very narrow coated abrasive products on narrow backings, because it is more economical to manufacture sheet material in a wider dimension and slit it to the desired width for a particular product. This would be logical reason why Hurst devoted no further attention to products of the other diemsnions he mentions. THus I believe that any product produced by the Hurst method having eight or more yarns would not normally have such yarns aligned within my definition of substantially coparallel and thus could not achieve the same desirable characteristics in wide coated abrasive products as I can achieve in the products made by my very different methods.

There is another important reason why the Hurst patent would not obviously suggest my invention to one skilled in coated abrasives. This is given by page 4, lines 34–42, where it is stated that "the grain...is expressed between presure bearing members that press the grain into the mass to imbed at least a part of it into the mass". There could scarcely be a less effective way of achieving the grain orientation normally achieved by electrostatic coating, which contributes greatly to the effectiveness of the vast majority of current commercial coated abrasives and has done so since a few years after the issuance in 1932 of U.S. Pat. No. 1,854,071. It is well known to manufacturers of coated abrasives that applying any significant mechanical pressure to grain to imbed it in an adhesive produces coated abrasive products with very disadvantageous grain orientation and consequent relatively ineffective performance. Thus, any worker in the coated abrasive art who might be initially attracted to extend Hurst's teachings to the vast majority of uses for coated abrasives, which require products more than one quarter inch in width (cf. Hurst, page 7, lines 70–71), would quite reasonably be dissuaded from such an effort by knowledge of the poor grain orientation which Hurst's teachings inevitably produce. It is an inherent feature of my invention, and an important distinction from Hurst, that conventional electrostatic coating can be employed to make the product of my invention.

The part of the Raymond specification which I consider most relevant to the present Application is Example I. This generally describes an object with abrasive grain coated on a flexible backing reinforced with a single layer array of substantially coplanar and coparallel yarns. Raymond, however, nowhere suggests that such a structure is useful for the normal purposes of a coated abrasive, i.e., to dimension or finish a material object. Raymond's only described use for this particular embodiment of his invention is for "building up more complicated rotative abrasive structures" (page 3, lines 13–14). These rotative structures, as described at length by Raymond, are of the type known commercially as bonded abrasives or grinding wheels rather than coated abrasives. The particular distinction of most relevance here is that bonded abrasives are desirably as rigid as possible; this is recognized by Raymond on page 1, lines 36–38 by the words, "The prevention of...flexural failure of rotative abrasive articles is...a primary object of the present invention". On the other hand, coated abrasives as described herein must be flexible.

The temporarily flexible partially cured structures (column 4, line 19 et. seq.) described by Raymond, would, in fact, be ineffective coated abrasives, because their partially cured resins would not be strong enough to hold the abrasive grits under the forces of grinding, if used in any form as a coated abrasive. On the other hand, all the structure disclosed by Raymond which contain more than one layer of reinforcing yarns have already been hardened into rigid bonded abrasives, and thus are distinct from my invention.

The parts of the Furgal patent which I consider most relevant are col. 1, lines 15–20; col. 2, lines 12–14 and 37–47; and claim 5. Furgal describes a sponge capped on each side by a "non-woven fabric...formed of laminates of aligned fibers" (col. 1, lines 18–20). At col. 2, lines 12–14 it is stated that the fibers are parallel to each other in one layer and perpendicular to those in another adjacent layer. At col. 2, lines 37–47, it is noted that abrasive particles may be present on the surface of the laminate. My invention is distinct from that of Furgal and not obvious in view of Furgal for the following reasons:

(1) Furgal describes his abrasive particles as "clampingly held" by the fibers of the non-woven fabric and states that this mode of attachment is an advatnage of his invention because of the scouring action achieved thereby (page 2, lines 40–47). I require the abrasive particles to be adhered to the backing, as is conventional for most industrial application of coated abrasives.

(2) Furgal gives no indication of the length of his aligned fibers in the written part of his specification; his drawings appear to contain frequent breaks in the lines representing such fibers. This is in sharp contrast to my invention which requires yarn arrays in which the yarns normally are continuous throughout the entire extent of a coated abrasive product.

(3) It is very unlikely that the fibers used by Furgal could meet the test of furnihsing most of the tensile strength of the backing, as I claim. In an attempt to investigate this point, I arranged for the purchase of a package of Handi-Wipes, which are specificed by Furgal as the non-woven backing used for his invention. As suspected, it was found that this material could easily be broken in pulling by hand, even in its strongest direction, and is thus not suitable to provide most of the strength of a commercial coated abrasive.

A considerably more surprising fact was also revealed by examination of this package of Handi-Wipes. The product now sold under this name does not conform to the description of the Furgal patent. Instead, these Handi-Wipes consist of fibers arranged in a geometrical pattern similar to that of a chain link fence, with no prominent arrays of fibers which are coparallel or even stright over a distance of more than a few millimeters. Thus, because Furgal gives not directions in his specification for providing the aligned fibers in his backing, other than to specify use of this trade-named product, the Furgal disclosure is no longer enabling as required under 35 U.S.C. 112 with respect to the provision of coated abrasives having backings with arrays of aligned textile yarns. (Presumably this situation arose because of a change in the nature of the trade-marked product between the issuance of the Furgal patent and the present time.).

Figure 1:
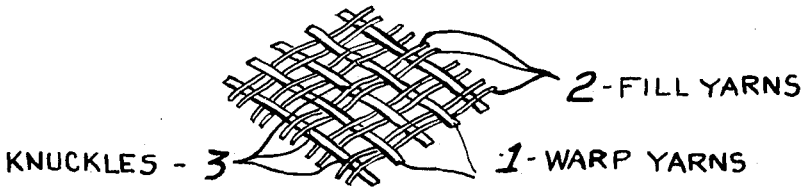
FIG. 1 is a perspective generalized view of a typical woven fabric of the type that might be used as the substrate for a conventional coated abrasive backing.

DESCRIPTION OF THE SPECIFIC EMBODIMENTS Example 1

This example, a preferred construction but which is not intended as limiting in the specific details, employs a stitch bonded backing of the type disclosed in FIG. 9 of U.S. Pat. No. 2,890,579 to Mauersberger. The fabric of the example was made on a Malimo machine (available from Unitechna Aussenhandelgesellschaft mbH, DDR-108 Berlin, Mohrenstrasse 53/54 GDR). The approximately 4 inch wide carrier for the fill yarns holds 61 ends, and makes one complete cycle from one edge of the web and back for every 4 inch longitudinal forward motion of the web. For a 60 inch wide machine this produces a fill yarn array which crosses the warp yarns at an angle of about 88° in one direction and 92° in the other. The stitching yarns, which bind the warp to the fill are 70 denier continuous filament polyester. The stitch length is 1.2 mm. The warp yarns are 1000 denier duPont type 68 continuous filament high tenacity polyester (9.2 grams per denier breaking strength), and the warp count is 14 ends per inch. The fill yarns are continuous filament 170 denier (containing 33 filaments) available from Celanese Corporation as type 731 polyester. These yarns have a low twist (0.25 per inch) and are texturized to provide a bulky yarn for optimum adhesion to coatings later applied. The tenacity is 3.5 to 3.9 grams/denier and the elongation is 18 to 24% at break. The yarn is preferably not treated with a coning oil.

The above described backing was then saturated with a resin and acrylic latex composition to prepare it for front-filling, back-filling, and coating with amker grain and size coat. A heat setting step is combined with the drying of the saturant. The fabric finishing steps will now be described in more detail.

Saturation and Heat Setting

Standard sizing rolls are employed to apply the following composition in the amount of 3 to 4 pounds per sandpaper makers ream (330 square feet). The fill yarn side of the fabric was facing up.

| Saturant Composition: | |
|---|---|
| Cymel 482, available from American Cyanamid, a melamine-formaldehyde resin syrup 80% solids, pH 8 to 9 | 160 parts |
| Beetle 7238, available from American Cyanamid, a urea formaldehyde resin syrup | 124 parts |
| water | 120 parts |
| aqueous solution containing 15% $NH_4Cl$ and 24% 2-amino-2-methyl propanol | 13 parts |
| 5 to 7 parts pigment dispersions may be added to color backing. | |

Upon completion of the application of the saturant the fabric is dried on a tenter frame for at least 3 minutes in a hot air oven in which the temperature in the entry zone is 205° F., and the temperature at the exti zone is 350° F. A tension of at least 2 pounds per inch of width is maintained on the fabric during its travel through the oven. This process not only dries the saturant but also heat-sets the fabric.

Front Fill Coating

The composition of the front fill coating, applied to the fill yarn side in this example, but which can instead be applied to the warp yarn side if desired, is as follows:

| | |
|---|---|
| (1) phenol-formaldehyde A stage resol resin syrup having a formaldehyde to phenol ratio of 1.5 and a solids content of 78% | 199 parts |
| (2) $CaCO_3$ | 160 parts |
| (3) sodium lauryl sulfate | 2 parts |
| (4) Hycar 2600 × 138, a latex of an acrylic acid ester polymer having a glass transition temperature at 25° C. available from B. F. Goodrich Chemical Company | 54 parts |

The front fill coating composition is applied with a box knife in the amount of 10 to 11 pounds per ream, and water may be added as necessary to maintain the required viscosity for proper coating. The coated cloth is again dried ona tenter frame with a tension of at least 2 pounds per inch of width by passing through a hot air oven in which the entry temperature is 205° F. and the exit zone temperature is 300° F.

Back Fill Coating

To the side not coated with the front fill is applied a back fill of the following composition.

| | |
|---|---|
| (1) Beetle 7238 urea formaldehyde resin syrup available from American Cyanamid | 133 parts |
| (2) Nopco NXZ anti-foam agent, available from Nopco Chemical Co., Newark, New Jersey | 5.3 parts |
| (3) UCAR 151 adhesive, a polyethylene, polyvinyl acetate 60% aqueous dispersion, available from Union Carbide Corporation, having a pH of 4 to 6 | 133 parts |
| (4) air washed clay | 176 pounds |
| (5) aqueous solution containing 15% $NH_4Cl$ and 24% 2 amino 2 methyl propanol | 5.3 parts |
| (6) water - to adjust viscosity to 11000 cps at room temperature, as needed (pigment may be added if desired to color backing). | |

The composition is applied by knife coating in the amount of 10 pounds per ream, and dried in an oven having an entry zone temperature of 150° F. and an exit zone of 200° F.

The thus coated fabric is now rady for application of a maker coat of phenolic resin, the application of abrasive, and the application of an abrasive size coat, as is conventional to be applied to the front sized side of the backing is as follows:

| | |
|---|---|
| (1) phenol-formaldehyde alkaline catalyzed resol resin, F/P factor 2.08, pH 8.7, solids 78% in water | 7 parts |
| (2) phenol-formaldehyde alkaline catalyzed resol resin, F/P 0.94, pH 8.1, solids in $H_2O$ 78% | 3 parts |
| (3) $CaCO_3$ | 1.54 × total solids |

To the adhesively coated fabric is then applied by conventional electrostatic means 35.4 lbs./sandpaper maker's ream (330 square feet) grit 60 high purity aluminum oxide abrasive grain. The abrasive-adhesive coated backing member is then heated for 25 minutes at 170° F., 25 minutes at 190° F., and 47 minutes at 225° F. to provide a dry adhesive layer (17.4 lgs/S.P.M.R.) and to anchor the abrasive grains in the desired orientation.

Afterwards, a size coat (10.6 lbs./S.P.M.R. dry) of the same composition as the maker coat, except of lesser viscosity, is then applied according to usual techniques. The wet adhesive layer is then dried: 25 minutes at 125°

F., 25 minutes at 135° F., 18 minutes at 180° F., 25 minutes at 190° F., and 15 minutes at 226° F., after which a final cure at 230° F. for 8 hours is given. The coated abrasive material is then ready to be converted according to usual techniques, into belts, discs, and other desired abrasive products.

While the above exmaple described finishing the backing with the abrasive coat on the fill side of the cloth, in other cases it may be more desirable to coat on the warp side.

It should be noted that a central feature of the invention is the use of yarn arrays which are not interlaced as in conventional woven fabrics, and the use of the terms "warp" and "fill" in the description of fabrics bonded by other means than weaving does not imply such interlacing.

The abrasive sheet material of the above example can be formed into belts by conventional joining techniques well known in the art. Particularly suitable are the butt joints described in U.S. Pat. Nos. 3,665,600 and 3,787,273. Lapped joints as described in U.S. Pat. No. 4,194,618 may also be used. In such cases it may be desirable to apply the front fill coating and the abrasive and maker on the warp side of the backing, instead of on the fill side. In the case of butt joints, the backing may be coated on either one side or the other.

Example 2

An adhesively bound coated abrasive backing of this invention was prepared by crossing two sets of substantially parallel spun polyester-yarn (3–5 gm/denier tenacity, 19 singles, cotton count) between the top and bottom platens of a photographic dry mounting press (manufactured by Seal, Inc.), the upper platen of which is electrically heated to a temperature of 340° to 350° F. A sheet of polyamide hot melt adhesive web (Bostik No. 5350 available from USM Corp.) was inserted between the yarn layers and the press closed to fuse and set the adhesive. A laminating time of approximately 45 seconds was used. The press was opened, the cross-direction yarn beam cut free, and the machien direction yarn beam advanced to bring the next adjacent portion of yarn over the bottom platen of the press. The cross-direction yarn beam was the nbrought through the press to cross the other beam and the bonding process repeated. Approximatley 8 yards of fabric was prepared in this manner. The fabric so prepared contained a density of 93 yarns/inch in the machine direction and 47 yarns/inch in the cross-direction, yielding a calculated areal weight of 6.81 oz/yd$_2$. The count and density of fabrics thus prepared are readily varied by varying the counts and weights of yarn(s) used in the respective beams.

The fabric was then heat-stretched by passing it over a catenary-shaped surface at a speed fo 20 ft/min while under a linear tension of 15 lbs/inch of width. During this operation, the fabric was heated to 400° F. by infrared radiators on the opposite side of the web from the catenary surface. In this way the machine direction breaking strength of the fabric was increased from 158 lbs/inch of width to 179 lbs/inch of width, and the elongation to break of the fabric was reduced from 32% to 20%.

The following formulation was then applied to the cross-direction side of the heat-stretched fabric, using a conventional bar coated with a 0.017 inch gap:

| | |
|---|---|
| (1) Duracryl 820, a 45% solids acrylic latex, available from Charles S. Tanner Inc., Greenville, S.C. | 133 parts |
| (2) An alkaline catalyzed bisphenol-formaldehyde resin syrup, F/P factor 4.18, at 73% solids. | 87 parts |
| (3) Calcium carbonate | 200 parts |
| (4) Alfonic 1012-60, a non-ionic surfactant, available from Charles S. Tanner Co. | 7/16 parts |
| (5) Water | 25 parts |

A drying time of 2 min. at 200° F. was used. After drying, the machine direction side of this fabric was then coated to 20 lbs/sandpaper ream with a conventional laboratory knife-on-roll coater using the following frontsize formulation:

| | |
|---|---|
| (1) An alkaline catalyzed bisphenol-formaldehyde resin syrup, F/P factor 4.18, at 73% solids. | 195 parts |
| (2) An alkaline catalyzed phenol-formaldehyde resin syrup, F/P factor 0.94, at 78% solids. | 20 parts |
| (3) $CaCO_3$ | 150 parts |
| (4) Alfonic 1012-60, a non-ionic surfactant available from Charles S. Tanner Co. | 3.6 parts |
| (5) Water | 45 parts |

This material was then oven dried for 5 minutes at 250° F.

The thus prepared fabric was now ready for application of a maker coat of phenolic resin, the application of abrasive, and the application of an abrasive size coat, as is conventional and well known in the art.

(In recognition of readiness for the application of maker adhesive and abrasive grain, the thus prepared fabric may be henceforward denoted as a backing.) A typical formulation applied to the front sized side (i.e., the side on which machine direction yarns were originally exposed) of the backing was as follows:

| | |
|---|---|
| (1) phenol-formaldehyde alkaline catalyzed resol resin, F/P factor 2.08, pH 8.7, solids 78% in water. | 7 parts |
| (2) phenol-formaldehyde alkaline catalyzed resol resin, F/P 0.94, pH 8.1, solids in $H_2O$ 78%. | 3 parts |
| (3) $CaCO_3$ | 1.54 × total solids |

To the adhesively bonded backing was then applied by conventional electrostatic means 50 lbs/sandpaper maker's ream (330 square feet) grit 50 eutectic composition, $Al_2O_3/ZrO_2$ abrasive grain (availble from Norton Co., Worcseter, Mass.). The abrasive-adhesive coated backing member was then heated for 25 minutes at 170° F., 25 minutes at 190° F., and 47 minutes at 225° F. to provide a dry adhesive layer 917.4 lbs./S.P.M.R.) and to anchor the abrasive grains in the desired orientation.

Afterwards, a size coat of the same composition as the maker coat, except of lesser viscosity, was then applied according to usual techniques. The wet adhesive layer was then dried: 25 minutes at 125° F., 25 minutes at 135° F., 18 minutes at 180° F., 25 minutes at 190° F. and 15 minutes at 225° F., after which a final cure at 230° F. for 8 hours is given. The coated abrasive material was then ready to be manufactured according to usual techniques, into belts, discs, and other desired abrasive products.

A sample of coated abrasive material, thus prepared, was converted into 2½"×60" abrasive belt products.

Other coated abrasive belts were also prepared, using the same means and formulations as the material of this invention, with the exception that the backing substrate fabric used was a conventionally woven polyester spun yarn backing (2×1 drills construction; 66 ends per inch and 44 picks per inch; yarn 3–5 gm/denier, warp, 12's and filling, 15's cotton count). The warp (twill) side of this cloth was used as the frontside. The product of this invention, using the previously disclosed adhesively bound backing (Product A) was compared to the product prepared by using the conventionally interwoven backing (Product B) in a series of grinding operations.

Test #1

Four different bars of AISI C1018 steel (½"2½"×9¾") were alternately ground on their narrow faces with a test machine which used a 55 durometer cog tooth contact wheel, at 15 lbs deadweight force, operating at a belt speed of 5000 surface feet per minute. Two belts of each product type, with the running direction of the belts coinciding with the warp or machine direction of the backing, were tested. The end of the useful life of each belt was judged to have occurred when no more than 5.0 grams of steel could be removed during a 2.0 minute period of continuous grinding.

| | Total Weight of Steel Removed |
|---|---|
| Product A - belt #1 | 609 grams |
| Product B - belt #2 | 608 grams |
| Product A - belt #2 | 639 grams |
| Product B - belt #2 | 619 grams |

Test #2

In this test, a piece of AISI 1020 hot-rolled steel angle iron (⅛"×1"×9¾") was ground at a 15° angle to one of its ⅛" faces. A 90 durometer plain face rubber contact was used with a belt speed of 5000 surface feet per minute. The force used to apply the abrasive was approximately 8.5 lbs of deadweight. In this application, abrasive grain, and the maker and size adhesive coats are normally shed from the backing at a high rate. The end of the useful life of the product normally occurs when all of the abrasive grain has been stripped from the backing.

| | Time to Shed | Grams of Steel Removed |
|---|---|---|
| Product A - belt #1 | 5.0 minutes | 166 |
| Product B - belt #1 | 3.5 minutes | 99 |
| Product A - belt #2 | 5.0 minutes | 158 |
| Product B - belt #2 | 3.5 minutes | 94 |

In the case of product B, wherein the backing used was of conventional woven design, both belts tested showed evidence of severe damage to the filling yarn, with the second belt of the two splitting and breaking apart to terminate the test. No such damage was found to have occurred to the backing of the product A herein disclosed.

Figure 2:
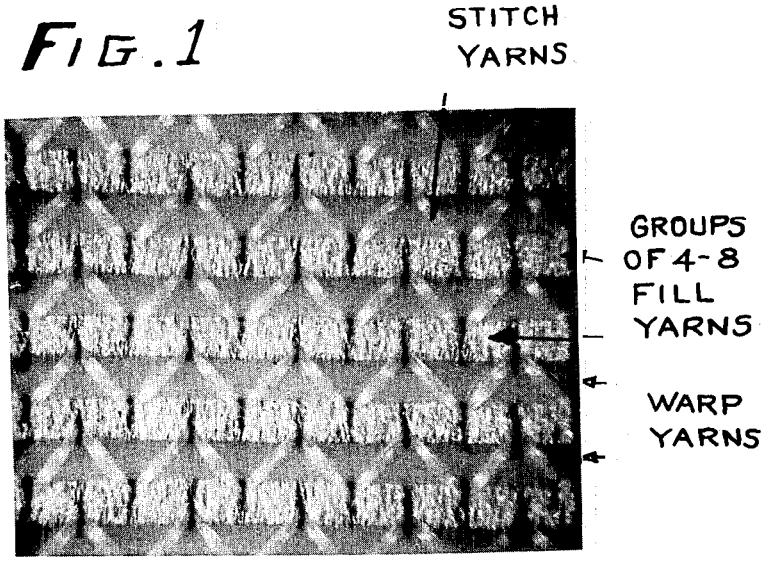
FIG. 2 is a photomicrograph at about ten power magnification of a Malimo fabric which is a preferred type of substrate for the present invention. The view is from the warp side of the fabric, but fill yarns may also be seen in the background behind the warp yarns.

The reason for the difference ins suceptibility of these two product to backing damage can be better understood with the aid of FIGS. 1 and 2. In both backings, the resistance of the belt to elongation and breakage from the tensile force used to hold the belt in place for rotation is primarily due to the warp yarns, and the resistance to splitting and sidewise elongation is primarily due to the fill yarns. As shown by FIG. 1, in product B the outermost surfaces of both types of yarns are curved into the knuckles discussed earlier. This curvature causes the outermost part of the yarn surface to be stretched more than the average for the yarn as a whole, thus decreasing its resistance to breakage. Moreover, it breakage does occur in the outermost part of a curved yarn surface, the break tends to propagate rapidly in the well-known "notch effect". As a result, once a small part of the outer surface of a yarn in the knuckle area is broken, the entir eyarn usually breaks. Breakage of some of the yarns transfers the tension which they formerly bore to the remaining intact yarns in the same direction, thus increasing the strain on them and increasing the likelihood that they will break. By this sequence of processes, relatively modest mechanical damage to a coated abrasive backing reinforced only with woven cloth often leads to product breakage.

Figure 3:
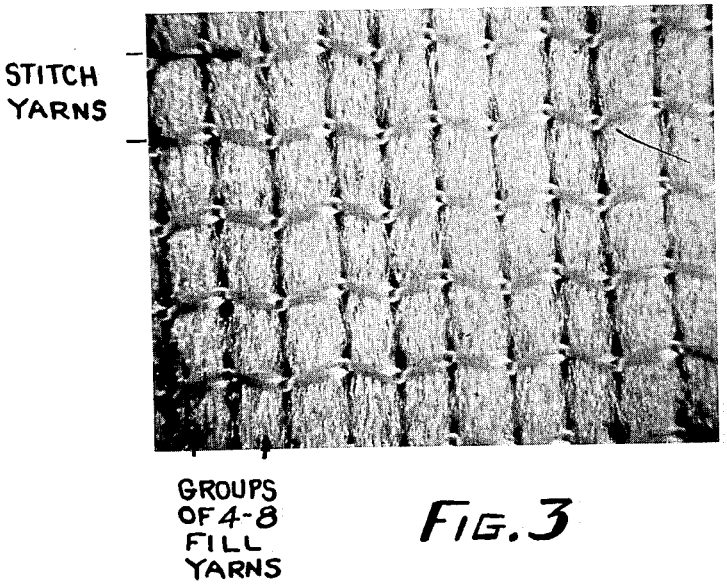
FIG. 3 shows the same fabric as FIG. 2, but the view is from the fill yarn side; the warp yarns are almost totally obscured from view. Stitch yarns, which are the only interlaced yarns in this fabric, are visible on both sides.

In contrast, a shown in FIGS. 2 and 3 (which for this example should be imagined not to contain the stitch yarns shown), in Product A all warp and fill yarns can lie flat, without knuckles, throughout the product. No notch effect is operative, so that if a small portion of the outer surface of one of the yarns is damaged, the remainder of the yarn generally remains intact and continues to bear the mechanical load. In particular, it is possible and preferred for most purposes, to coat the abrasive grits on the side of the backing opposite the warp yarns, thereby achieving maximum protection of the yarns normally most critical to the integrity of a coated abrasive belt. On the other hand, when designing coated abrasives for special applications in which splitting failure of a belt is more liely than tensile failure in the perpendicular direction, the belt backing can be coated on the warp side to maximally protect the fill yarns which confer splitting resistance. With woven cloth, inherently, both directions of yarn will be exposed on the side of maximum danger at many points in any belt of normal dimensions.

Example 2 above has illustrated one of the coated abrasives of this invention having a backing without bonding yarns of any kind. It will be appreciated by those skilled in the art that many variations from this specific example could be made within the scope of this invention. For example, if greater economy in the product were necessary, the cross-direction set of reinforcing yarns could have been eliminated. Belts made from the product would then have had less resistance to splitting but could have been satisfactory for certain users. The choice of adhesive could be varied within wide limits to give the combination of flexiblity and damage resistance most suitable to the intended use of the coated abrasive product.

It should also be readily appreciated that more complex mechanical arrangements could be used to assemble the material described in Example 2 at high speed. A variety of methods for different adhesives are described in U.S. Pat. No. 3,250,655 to Adler, and a more modern technique suitable for certain types of adhesives and yarns is described in U.S. Pat. No. 4,295,905 to Bascom, et al., for which the application was filled after my original conception of this invention.

Example 3

If greater economy than obtained with example 1 is desired, and reduced splitting resistance may be tolerated, a suitable backing can be made with only one array of reinforcing yarns. For example, cotton 18's singles yarn was wound onto the surface of a cylinder coated with polytetrafluoroethylene at a spacing to give 72 yarns per inch when measured parallel to the axis of the cylinder. A coating of Hycar 2679X6, an acrylic polymer latex adhesive supplied commecially by B. F. Goodrich Chemical Company, was then applied in sufficient thickness to completely cover the layer of yarn. The cylinder with its wet coating of adhesive was turned slowly in slightly warmer than ambient air until the adhesive had dried completely to a continuous film encapsulating the cotton yarns. A cut was the made along a line on the surface of the dried composite parallel to the axis of the cylinder, and the resulting sheet of yarn-adhesive composit stripped from the cylinder. The yarn-adhesive composite is then used as the backing for the preparation of a coated abrasive, using the same maker and size adhesives and abrasive grain and the same techniques as described for example 1 and 2.

I claim:

1. An improved flexible coated abrasive sheet material having abrasive grains adhesively bonded to one side of a backing, said backing comprising:

(a) a first array of non-interlaced substantially coplanar and coparallel reinforcing textile yarns, a second overlaid array of non-interlaced substantially coplanar and coparallel reinforcing textile yarns said first and second arrays being oriented in two distinct directions from one another, said textile yarns of each array, together with the yarns of any other distinct arrays of non-interlaced substantially coplanar and coparallel reinforcing textile yarns present in the back and oriented in the same direction, furnishing most of the tensile strength of said coated abrasive in the direction of orientations of said array, and (b) cured adhesive material substantially filling the spaces between the yarns of said first and second arrays and bonded thereto.

2. A flexible coated abrasive sheet material according to claim 1 in the form of an endless belt.

3. A flexible coated abrasive sheet material according to claim 1 in which one of any said first and second arrays contains yarns of high bulk as compared to the yarns of the other array.

4. A flexible coated abrasive sheet material according to claim 1 in which the distinct arrays are bound to each other by a stitching yarn.

5. A flexible coated abrasive sheet material according to claim 3 in which said one array comprises texturized continuous filament yarns or staple yarns.

6. An article according to claim 1 further including a tissue sheet.

7. An article according to claim 1 in which the first and second arrays are solely adhesively bonded to one another.

8. A flexible coated abrasive sheet material according to claim 1 in which the said first and second arrays of yarns correspond to the warp and fill yarns of a coherent stitch-bonded fabric.

9. A flexible coated abrasive sheet material according to claim 8, wherein the abrasive grains are adhesively bonded to the fill yarn side of the sheet material.

10. A flexible coated abrasive sheet material according to claim 9, wherein the sheet material is in the form of an endless belt.

11. A flexible coated abrasive sheet material according to claim 2, wherein the running direction of the belt coincides with the warp direction.

12. A flexible coated abrasive sheet material according to claim 1, wherein the yarns of the first and second arrays are natural yarns, synthetic organic yarns, glass yarns or metal yarns.

13. A flexible coated abrasive sheet materila, comprising:

(a) a fabric backing including:

(i) an array of warp yarns that extend generally parallel to one another in a first plane, (ii) an array of weft yarns that extend generally parallel to one another in a second plan adjacent and parallel to said first plane, said weft yarns extending generally transversely of said warp yarns, and (iii) a stitching yarn network joining said array of warp yarns and said array of weft yarns to one another;

(b) a size of flexible polymeric material that coats the yarns of said fabric;

(c) an adhesive coat on one side of said fabric, said adhesive coat being applied after said size; and (d) abrasive grains adhesively bonded to said backing by said adhesive coat.

14. The flexible coated abrasive sheet mateial of claim 13 wherein said weft yarns comprise yarns of high bulk as compared to the warp yarns, and wherein said adhesive coat is applied to the weft yarn of said fabric.

15. A flexible coated abrasive sheet material in accordance with claim 14 in which said weft yarns comprise texturized continuous filament yarns or staple yarns.

16. The flexible coated abrasive sheet material of claim 13 in which said fabric backing further includes a non-woven web.

17. The flexible coated abrasive sheet material of claim 16 in which said non-woven web is located between the array of warp yarns and the array of weft yarns.

18. The flexible coated abrasive sheet material of claim 13 in the form of an endless belt.

* * * * *